US005595966A

United States Patent [19]

Rees et al.

[11] Patent Number: 5,595,966

[45] Date of Patent: Jan. 21, 1997

[54] BIODEGRADABLE LUBRICANTS AND FUNCTIONAL FLUIDS

[75] Inventors: Mark Rees, Reading; Ian MacPherson, Maidenhead, both of England

[73] Assignee: Ethyl Petroleum Additives Limited, Bracknell, England

[21] Appl. No.: 732,501

[22] Filed: Jul. 18, 1991

[30] Foreign Application Priority Data

Jul. 24, 1990 [EP] European Pat. Off. ..... 90308076

[51] Int. Cl.[6] ..... C10M 105/04

[52] U.S. Cl. ..... 508/591; 585/10; 585/12; 252/73

[58] Field of Search ..... 585/10, 12

[56] References Cited

U.S. PATENT DOCUMENTS

| | | | |
|---|---|---|---|
| 3,780,128 | 12/1973 | Shubkin | 585/12 |
| 4,175,047 | 11/1979 | Schick et al. | 252/56 S |
| 4,282,392 | 8/1981 | Cupples et al. | 585/10 |
| 4,417,082 | 11/1983 | Larkin et al. | 585/12 |
| 4,827,073 | 5/1989 | Wu | 585/12 |
| 4,992,183 | 2/1991 | Beimesch et al. | 252/515 A |
| 5,089,156 | 2/1992 | Chrisope et al. | 252/51.5 A |
| 5,093,539 | 3/1992 | Firk et al. | 585/10 |

FOREIGN PATENT DOCUMENTS

| | | |
|---|---|---|
| 0004425 | 10/1979 | European Pat. Off. . |
| 0103884 | 3/1984 | European Pat. Off. . |
| 2295121 | 7/1976 | France . |
| 1520107 | 8/1978 | United Kingdom . |
| 1525392 | 9/1978 | United Kingdom . |

*Primary Examiner*—Ellen M. McAvoy
*Attorney, Agent, or Firm*—Dennis H. Rainear

[57] ABSTRACT

Certain hydrogenated oligomers of 1-alkene hydrocarbons have been found to be substantially biodegradable upon exposure to microbiological agents of types widely available in the environment. Thus, in an operation wherein lubricating oil or functional fluid is released into the environment, there is provided for use as the lubricating oil or functional fluid a substantially biodegradable lubricating oil or functional fluid at least 10 percent by volume of which is composed of at least one substantially biodegradable liquid hydrocarbon of lubricating viscosity formed by oligomerisation of 1-alkene hydrocarbon having 6 to 20 carbon atoms in the molecule and hydrogenation of the resultant oligomer.

26 Claims, No Drawings

BIODEGRADABLE LUBRICANTS AND FUNCTIONAL FLUIDS

As is well known, there are many situations wherein oleaginous fluids are released into the environment. For example, lubricating oils utilised in the operation of outboard motors, chain saws, and other types of field equipment almost inevitably come in contact with the land and water surfaces of the earth. The same is true of oleaginous liquids used as carriers or diluents in agricultural sprays, such as herbicides and plant growth regulants. It is also commonplace for engine oils, transmission oils, gear box oils, etc., to leak onto pavement or ground surfaces and thus eventually find themselves in the natural environment. Another source of such releases to the environment involve rupture or leakages from high pressure hydraulic systems such as vehicular brake lines, hydraulic systems used in construction and earth moving equipment or military vehicles or equipment, and the like. Paper mill oils and compressor oils likewise find their way into the natural environment.

Unfortunately, formulated mineral oil lubricants and functional fluids can be harmful to the environment, since in most cases they are not acceptably biodegradable. Yet, in many cases, only hydrocarbonaceous fluids were deemed to possess the requisite combination of properties for the purposes at hand and to meet the economic parameters involved in the production and usage of such products. For example, synthetic ester oils and natural oils such as rapeseed oil possess shortcomings with respect to such properties as oxidative stability (especially at elevated use temperatures), hydrolytic stability, filtrability, and demulsibility.

There is, therefore, a need for an efficacious way of reducing the extent and severity of such environmental abuse while at the same time providing lubricants and functional fluids possessing desirable physical properties within the confines of economic restraints. This invention is deemed to fulfill this need.

This invention involves, inter alia, the truly surprising discovery that certain hydrogenated oligomers of 1-alkene hydrocarbons are substantially biodegradable upon exposure to microbiological agents of types widely available in the environment. Thus in operations wherein lubricating oils and functional fluids are released into the environment, accidentally or otherwise, the provision and the use of lubricants and functional fluids containing such hydrogenated 1-olefin hydrocarbon oligomers can contribute materially to environmental protection. And moreover, such provision and such usage can be achieved without devastating consequences insofar as requisite performance properties and economic considerations are concerned.

Thus in accordance with one embodiment of this invention, in an operation wherein lubricating oil or functional fluid is released or likely to be released into the environment, there is provided the improvement which comprises providing for use as the lubricating oil or functional fluid a substantially biodegradable lubricating oil or functional fluid at least 10 percent by volume of which is composed of at least one substantially biodegradable liquid hydrocarbon of lubricating viscosity formed by oligomerisation of 1-alkene hydrocarbon having 6 to 20 carbon atoms in the molecule and hydrogenation of the resultant oligomer. In another embodiment of this invention, the improvement in such operation comprises using or utilising as the lubricating oil or functional fluid in such operation a substantially biodegradable lubricating oil or functional fluid at least 10 percent by volume of which is composed of at least one substantially biodegradable liquid hydrocarbon of lubricating viscosity formed by oligomerisation of 1-alkene hydrocarbon having 6 to 20 carbon atoms in the molecule and hydrogenation of the resultant oligomer.

By "substantially biodegradable" in this specification and in the appended claims is meant that the oleaginous liquid in question has a biodegradability when tested and reported in accordance with test method CEC L-33-T-82 of at least 20%, preferably at least 30%, and more preferably at least 40%. It is also to be noted that for the purposes of this invention the term "functional fluid" as used in the specification and claims includes solvents and/or carrier fluids (e.g., for agricultural sprays or formulations) as well as hydraulic fluids, quenching oils, cutting oils, machining oils, and the like.

Further embodiments of this invention include a substantially biodegradable lubricating oil or functional fluid composition which comprises at least 10% by volume of at least one substantially biodegradable liquid hydrocarbon of lubricating viscosity formed by oligomerisation of 1-alkene hydrocarbon having 6 to 20 carbon atoms in the molecule and hydrogenation of the resultant oligomer. In another of its forms, this invention relates to a substantially biodegradable lubricating oil or functional fluid composition of the type described above when in contact with at least one microbiological agent capable of causing biodegradation of at least a substantial portion of the substantially biodegradable liquid hydrocarbon of which such lubricating oil or functional fluid composition is comprised. In this form of this invention, such microbiological agent can be in the earth or in a body of water.

Yet another embodiment of this invention concerns a method which comprises causing a lubricating oil or functional fluid composition of this invention to come in contact with at least one microbiologial agent capable of causing biodegradation of at least a substantial portion of the substantially biodegradable liquid hydrocarbon content of such composition.

Other embodiments of this invention will be apparent from the ensuing description and appended claims.

Among the advantages of this invention are the surprising substantial biodegradability of the hydrogenated 1-olefin oligomeric lubricants and functional fluids utilised in accordance with this invention, together with the combination of desirable properties which they possess. For example, the substantially biodegradable hydrogenated poly-α-olefin lubricants and functional fluids of this invention possess in general better low temperature properties than comparable mineral oils. And as compared to synthetic ester oils and natural oils such as rapeseed oil, the substantially biodegradable lubricants and functional fluids of this invention generally possess superior oxidative stability (e.g., in the ASTM thermal oxidation stability test D 943), better hydrolytic stability (e.g., in the ASTM hydrolytic stability test D 2619), superior filtrability (e.g., in a wet filtration test), and better demulsibilty (e.g., in the ASTM demulsibility test D 1401).

Not all hydrogenated 1-alkene hydrocarbon liquid oligomers meet the substantially biodegradable requirements of this invention as above specified. Thus in any given situation recourse should be had to the simple expedient of subjecting the prospective hydrogenated 1-alkene liquid oligomer to the CEC L-33-T-82 test procedure in the manner therein specified to determine the % biodegradability of the oligomer under consideration. Generally speaking, hydrogenated liquid oligomers of linear 1-alkenes containing at least 50% dimer, trimer, and/or tetramer formed using a water or alcohol promoted Friedel-Crafts catalyst tend to possess the requisite biodegradability to be classified as substantially biodegradable and thus are preferred. Particularly preferred are liquid hydrogenated oligomers of linear 1-alkenes containing at least 80 or 90% dimer and/or codimer species. The 1-alkenes used to form such oligomers should contain from 6 to 20 carbon and preferably from 8 to 16 carbon atoms in the molecule. In addition, such 1-alkenes should be linear (i.e., substantially free of branching and cyclisation).

Methods for the production of such liquid oligomeric 1-alkene hydrocarbons are known and reported in the literature. See for example U.S. Pat. Nos. 3,763,244; 3,780,128; 4,172,855; and 4,218,330. Additionally, hydrogenated 1-alkene oligomers of this type are available as articles of commerce, for example, under the trade designations HITEC®162, HITEC®164, HITEC®166, and HITEC®168 poly-α-olefin oils (Ethyl Petroleum Additives, Ltd.; Ethyl Petroleum Additives, Inc.). Suitable 1-alkene oligomers may also be available from other suppliers. As is well known, hydrogenated oligomers of this type contain little, if any, residual ethylenic unsaturation. Preferred oligomers are formed by use of a Friedel-Crafts catalyst (especially boron trifluoride promoted with water or a $C_{1-20}$ alkanol) followed by catalytic hydrogenation of the oligomer so formed using procedures such as are described in the foregoing U.S. patents.

Other catalyst systems which may also be used to form oligomers of 1-alkene hydrocarbons, which, on hydrogenation, provide lubricants and functional fluids which may be substantially biodegradable, include Zeigler catalysts such as ethyl aluminum sesquichloride with titanium tetrachloride, aluminum alkyl catalysts, chromium oxide catalysts on silica or alumina supports and a system in which a boron trifluoride catalyst oligomerisation is followed by treatment with an organic peroxide.

Mixtures or blends of such 1-alkene oligomers can also be used in the practise of this invention provided the overall blend possesses the requisite biodegradability as specified above. Typical examples of suitable blends of hydrogenated 1-decene oligomers include the following blends in which the typical compositions are expressed in terms of normalised area percentages by GC and wherein "n.d." means "not determined":

75/25 Blend of HITEC 162 and HITEC 164 poly-α-olefin oils:

Composition—Monomer 0.3, Dimer 66.8, Trimer 27.3, Tetramer 4.8, Pentamer 0.8.

Properties—Viscosity at 100° C: 2.19 cSt; Viscosity at 40° C.: 7.05 cSt; Viscosity at −18° C.: 84.4 cSt; Viscosity at −40° C.: 464 cSt; Pour point: <−65° C.; Flash point (ASTM D 92): 166° C.; NOACK volatility: 78.2%.

50/50 Blend of HITEC 162 and HITEC 164 poly-α-olefin oils:

Composition—Monomer 0.2, Dimer 44.7, Trimer 45.9, Tetramer 7.6, Pentamer 1.3, Hexamer 0.3.

Properties—Viscosity at 100° C: 2.59 cSt; Viscosity at 40° C.: 9.36 cSt; Viscosity at —18° C.: 133 cSt; Viscosity at −40° C.: 792 cSt; Pour point: <−65° C.; Flash point (ASTM D 92): 168° C.; NOACK volatility: 57.4%.

25/75 Blend of HITEC 162 and HITEC 164 poly-α-olefin oils:

Composition—Monomer 0.1, Dimer 23.1, Trimer 62.7, Tetramer 11.5, Pentamer 2.1, Hexamer 0.5.

Properties—Viscosity at 100° C.: 3.23 cSt; Viscosity at 40° C.: 12.6 cSt; Viscosity at −18° C.: 214 cSt; Viscosity at −40° C.: 1410 cSt; Pour point: <−65° C.; Flash point (ASTM D 92): 190° C.; NOACK volatility: 30.8%.

95/05 Blend of HITEC 164 and HITEC 166 poly-α-olefin oils:

Composition—Dimer 0.5, Trimer 78.4, Tetramer 15.6, Pentamer 3.7. Hexamer 1.8.

Properties—Viscosity at 100° C.: 4.15 cSt; Viscosity at 40° C.: 17.9 cSt; Viscosity at −18° C.: n.d.; Viscosity at −40° C.: 2760 cSt; Pour point: <−65° C.; Flash point (ASTM D 92): 225° C.; NOACK volatility: 10.5%.

90/10 Blend of HITEC 164 and HITEC 166 poly-α-olefin oils:

Composition—Dimer 0.3, Trimer 76.0, Tetramer 17.0, Pentamer 4.7, Hexamer 2.0.

Properties—Viscosity at 100° C.: 4.23 cSt; Viscosity at 40° C.: 18.4 cSt; Viscosity at −18° C.: n.d.; Viscosity at −40° C.: 2980 cSt; Pour point: <−65° C.; Flash point (ASTM D 92): 228° C.; NOACK volatility: 11.4%.

80/20 Blend of HITEC 164 and HITEC 166 poly-α-olefin oils:

Composition—Dimer 0.3, Trimer 71.5, Tetramer 19.4, Pentamer 6.5, Hexamer 2.3.

Properties—Viscosity at 100° C.: 4.39 cSt; Viscosity at 40° C.: 19.9 cSt; Viscosity at −18° C.: n.d.; Viscosity at −40° C.: 3240 cSt; Pour point: <−65° C.; Flash point (ASTM D 92): 227° C.; NOACK volatility: 9.2%.

75/25 Blend of HITEC 164 and HITEC 166 poly-α-olefin oils:

Composition—Dimer 0.7, Trimer 69.0, Tetramer 21.0, Pentamer 7.3, Hexamer 2.0.

Properties—Viscosity at 100° C.: 4.39 cSt; Viscosity at 40° C.: 20.1 cSt; Viscosity at −18° C.: 436 cSt; Viscosity at −40° C.: 3380 cSt; Pour point: <−65° C.; Flash point (ASTM D 92): 226° C.; NOACK volatility: 14.2%.

50/50 Blend of HITEC 164 and HITEC 166 poly-α-olefin oils:

Composition—Dimer 0.4, Trimer 57.3, Tetramer 27.4, Pentamer 11.8, Hexamer 3.1.

Properties—Viscosity at 100° C.: 4.82 cSt; Viscosity at 40° C.: 23.0 cSt; Viscosity at −18° C.: 544 cSt; Viscosity at −40° C.: 4490 cSt; Pour point: <−65° C.; Flash point (ASTM D 92): 226° C.; NOACK volatility: 12.5%.

25/75 Blend of HITEC 164 and HITEC 166 poly-α-olefin oils:

Composition—Dimer 0.3, Trimer 45.3, Tetramer 33.4, Pentamer 16.4, Hexamer 4.6.

Properties—Viscosity at 100° C.: 5.38 cSt; Viscosity at 40° C.: 26.8 cSt; Viscosity at —18° C.: 690 cSt; Viscosity at −40° C.: 6020 cSt; Pour point: <−65° C.; Flash point (ASTM D 92): 250° C.; NOACK volatility: 9.2%.

25/25 Blend of HITEC 166 and HITEC 168 poly-α-olefin oils:

Composition—Dimer 0.4, Trimer 28.4, Tetramer 42.0, Pentamer 22.9, Hexamer 6.3.

Properties—Viscosity at 100° C.: 6.21 cSt; Viscosity at 40° C.: 33.7 cSt; Viscosity at −18° C.: 1070 cSt; Viscosity at −40° C.: 9570 cSt; Pour point: <−65° C.; Flash point (ASTM D 92): 242° C.; NOACK volatility: 6.8%.

50/50 Blend of HITEC 166 and HITEC 168 poly-α-olefin oils:

Composition—Trimer 20.4, Tetramer 45.4, Pentamer 26.5, Hexamer 7.7.

Properties—Viscosity at 100° C.: 6.79 cSt; Viscosity at 40° C.: 38.1 cSt; Viscosity at −18° C.: 1180 cSt; Viscosity at −40° C: 12200 cSt; Pour point: <−65° C.; Flash point (ASTM D 92): 244° C.; NOACK volatility: 6.0%.

25/75 Blend of HITEC 166 and HITEC 168 poly-α-olefin oils:

Composition—Dimer 0.2, Trimer 13.8, Tetramer 48.0, Pentamer 29.2, Hexamer 8.8.

Properties—Viscosity at 100° C.: 7.27 cSt; Viscosity at 40° C.: 42.2 cSt; Viscosity at −18° C.: 1410 cSt; Viscosity at −40° C.: 15300 cSt; Pour point: −60° C.; Flash point (ASTM D 92): 248° C.; NOACK volatility: 4.3%.

It is also possible in accordance with this invention to utilise blends of one or more sufficiently biodegradable liquid hydrogenated 1-alkene oligomers in combination with other oleaginous materials which are themselves sufficiently biodegradable such that the resultant blend meets the biodegradability requirement of this invention, and provided further that the resultant blend possesses the requisite compatibility, stability and performance criteria for the use for which the blend is designed, formulated, and provided.

Illustrative non-oligomeric oils and fluids of lubricating viscosity which can be used in formulating substantially biodegradable lubricating oil and/or functional fluid blends pursuant to this invention, include synthetic esters such as mixed $C_9$ and $C_{11}$ dialkylphthalates (e.g., ICI Emkarate 911P ester oil), trimethylol propane trioleate, di-(isotridecyl)-adipate (e.g., BASF Glissofluid A13), pentaerythritol tetraheptanoate and the like; and liquid natural fatty oils and esters such as castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, and the like. Such oils may be partially or fully hydrogenated, if desired. Here again, the only requirements are that the resultant blend be substantially biodegradable within the meaning specified above and that the blend have the requisite properties for the intended use or uses therefor.

It is also possible to include small amounts of mineral oils in blends with one or more substantially biodegradable linear 1-alkene hydrocarbon oligomers, and such blends may in turn contain one or more other base oils (synthetic ester, polyalkylene glycol, natural fatty oil or ester, etc.), provided that the overall blend is itself substantially biodegradable. The amount of mineral oil which can be present in the foregoing blends will depend in large measure upon the structural and molecular characteristics of the mineral oil, such as the amount of methyl-branched and cyclic species present, configurations which resist biodegradation. Accordingly in any given situation recourse should be had to the CEC L-33-T-72 test procedure to insure that the proposed amount of the proposed mineral oil in the proposed overall blend does not prevent the overall blend from being substantially biodegradable.

Conventional amounts of conventional additives typically used in lubricating oils and/or in functional fluids can be utilised in the liquid hydrogenated 1-alkene hydrocarbon oligomer-containing compositions of this invention, provided of course that the additives as used are compatible with each other and are sufficiently soluble in the base oil at the desired concentrations to provide a homogenous solution at ambient temperatures. Examples of such additives, although well known to those skilled in the art, are given hereinafter. It is worth noting that such additives need not in and of themselves be biodegradable. The only requirement is that the concentrations employed—which are normally relatively low—in the base oil should not prevent the finished lubricant or functional fluid from remaining substantially biodegradable.

To still further protect the environment, this invention provides in accordance with preferred embodiments thereof, novel compositions which facilitate the detection of leakage and other excessive releases of lubricant and/or functional fluid to the environment. Thus to the extent, if any, that the lubricant or functional fluid composition is not biodegradable, early detection of such leakage or excessive release thereof to the environment enables prompt remedial action to be taken to arrest further leakage or excessive release to the environment.

In accordance with such preferred embodiments there are provided substantially biodegradable lubricating oil or functional fluid compositions which comprise a major proportion of an oleaginous fluid containing a small visually-perceptible chromophoric quantity of an oil-soluble chromophoric substance. Such oleaginous fluid comprises by volume at least 10 percent, preferably at least 25 percent, more preferably at least 50 percent, still more preferably at least 75 percent, and most preferably 90 percent or more of at least one substantially biodegradable liquid hydrocarbon of lubricating viscosity formed by oligomerisation of 1-alkene hydrocarbon having 6 to 20 carbon atoms in the molecule, and hydrogenation of oligomer so formed. Preferably, the chromophoric substance employed has a maximum absorption wavelength within the range of 300 to 650 millimicrons. Typical, but preferred, chromophoric substances have maximum absorption wavelengths respectively of 400, 420, 515, 518, and 640 millimicrons. A particularly preferred chromaphoric substance is comprised of a mixture of two chromophoric compounds, one having a maximum absorption wavelength of about 420 millimicrons and the other a maximum absorption wavelength of about 640 millimicrons, whereby the product has a green colouration.

The following examples, in which parts and percentages are by weight, illustrate but do not limit and should not be-construed as limiting, the practise of this invention.

EXAMPLE 1

A hydrogenated poly-α-olefin synthetic lubricating oil containing typically 90% hydrogenated 1-decene dimer and having a typical viscosity at 100° C. of 1.7 cSt, a typical specific gravity at 15° C. of 0.80 g/mL, a flash point of 155° C., and a pour point of −55° C. (HITEC®162 lubricating oil) was placed in contact with a bacterial inoculum from a sewage plant pursuant to test method CEC L-33-T-82. Upon completion of the test in accordance with such test method, the lubricant was found to have a biodegradation of 45%. Repetition of this procedure in another laboratory resulted in a biodegradation value of 92%.

EXAMPLE 2

The procedure of Example 1 is repeated except that the lubricant in this instance is a hydrogenated poly-α-olefin synthetic lubricating oil containing 82.7% hydrogenated 1-decene trimer and 14.6% hydrogenated 1-decene tetramer and having a typical viscosity at 100° C. of 3.9 cSt, a typical specific gravity at 15° C. of 0.82 g/mL, a flash point of 205° C., and a pour point of −65° C. (HITEC® 164 lubricating oil). This lubricant was found to have a biodegradation of 23% when subjected to test method CEC L-33-T-82.

EXAMPLE 3

Repetition of Example 1 using as the lubricant a hydrogenated poly-α-olefin synthetic lubricating oil containing typically 4.3% hydrogenated 1-decene trimer, 56.3% hydrogenated 1-decene tetramer and 33.9% hydrogenated 1-decene pentamer and having a typical viscosity at 100° C. of 8.0 cSt, a typical specific gravity at 15° C. of 0.835 g/mL, a flash point of 230° C., and a pour point of −55° C. (HITEC 168 lubricating oil). This lubricant was found to have a biodegradation of 24% when subjected to test method CEC L-33-T-82.

COMPARATIVE EXAMPLE

Application of the procedure of Example 1 to several other synthetic poly-α-olefin lubricants having typical viscosities at 100° C. of 10, 40, and 100 cSt respectively, gave the following biodegradation results in test method CEC L-33-T-82: 10 cSt=10% and 6% (results of two separate laboratories); 40 cSt =4%; and 100 cSt=16%.

EXAMPLE 4

A suitably formulated lubricant containing as the base oil the hydrogenated poly-α-olefin synthetic lubricating oil as described in Example 3 is provided for use as a chain saw lubricant. When the lubricant is released to the natural environment, it is biodegraded to a greater extent than a naphthenic mineral oil of the same viscosity.

EXAMPLE 5

A suitably formulated lubricant containing as the base oil the hydrogenated poly-α-olefin synthetic lubricating oil as described in Example 3 is provided for use as a lubricant for two-cycle engines. When the lubricant is released to the natural environment, it is biodegraded to a greater extent than a blend of the same viscosity composed of paraffinic and naphthenic mineral oils.

EXAMPLE 6

A suitably formulated lubricant containing as the base oil the hydrogenated poly-α-olefin synthetic lubricating oil as described in Example 1 is provided for use as a fluid for use in vehicular shock absorbers. When the lubricant is released to the natural environment, it is biodegraded to a greater extent than a blend of the same viscosity composed of paraffinic, aromatic and naphthenic mineral oils.

EXAMPLE 7

Three chromophoric lubricant and functional fluid base oil compositions of this invention are formed by blending with the synthetic lubricating oils as described in Examples 1, 2, and 3, 0.01% of a methyl derivative of azobenzene-4-azo-2-naphthol having a maximum absorption wavelength of 518 millimicrons and an approximate pour point of −26° C. (C.I. Solvent Red 164). Leakage or spillage of these substantially biodegradable lubricant compositions is readily perceived by the naked eye.

EXAMPLE 8

Three chromophoric lubricant and functional fluid base oil compositions of this invention are formed by blending with the synthetic lubricating oils as described in Examples 1, 2, and 3, 0.02% of a mixture of p-diethylaminoazobenzene having a maximum absorption wavelength of 420 millimicrons and 1,4-diisopropylaminoanthraquinone having a maximum absorption wavelength of 640 millimicrons and an approximate pour point of −46° C. Leakage or spillage of these substantially biodegradable lubricant compositions is readily perceived visually.

EXAMPLE 9

Three chromophoric lubricant and functional fluid base oil compositions of this invention are formed by blending with the synthetic lubricating oils as described in Examples 1, 2, and 3, 0.025% of benzene-azo-2-naphthol having a maximum absorption wavelength of 400 millimicrons and an approximate pour point of −23° C. Leakage or spillage of these substantially biodegradable lubricant compositions is readily perceived visually.

EXAMPLE 10

A functional fluid is formed by blending together equal volumes of the hydrogenated poly-α-olefin synthetic lubricating oil as described in Example 1 and rapeseed oil. This functional fluid is provided for use as a hydraulic fluid and solvent for herbicides. When the functional fluid is released to the natural environment, it is biodegraded to a greater extent than a conventional mineral oil of the same viscosity.

EXAMPLE 11

A series of 16 chromophoric substantially biodegradable base oil compositions of this invention are formed by dissolving the combination of Hoechst Fat Blue B at a concentration equivalent to 0.04g/400mL and Hoechst Fat Yellow 3 G at a concentration equivalent to 0.10 g/400mL into HITEC 162 poly-α-olefin oil, into HITEC 164 poly-α-olefin oil, into HITEC 166 poly-e-olefin oil, into HITEC 168 poly-α-olefin oil, and into each of the 12 blends of such oils described hereinabove in detail both as regards composition and properties. When in contact with microbiological agents in the natural environment (soil or water) such base oils are substantially biodegraded into innocuous materials.

The substantially biodegradable lubricants and functional fluids of this invention can be employed in a wide variety of applications. For example they can be employed as base oils for crankcase lubricants, automotive gear lubricants, transmission oils, hydraulic oils, paper mill oils, compressor oils, outboard motor lubricants, chain saw lubricants, carriers for herbicides and plant growth regulants, and for other similar uses. When in the course of such usage the substantially biodegradable base oils of this invention are released into the environment, accidentally or otherwise, and come in contact with microbiological agents in the natural environment, the oils are substantially biodegraded and thus such oils are much less offensive to the environment than substantially non-biodegradable base oils.

Well known additives which may be included in the compositions of this invention include the zinc dialkyl ($C_3$–$C_{10}$), dicycloalkyl ($C_5$–$C_{20}$), and/or diaryl ($C_6$–$C_{20}$) dithiophosphate wear inhibitors, generally present in amounts of about 0.5 to 5 weight percent. Useful detergents include the oil-soluble normal basic or overbased metal, e.g., calcium, magnesium, barium, etc., salts of petroleum naphthenic acids, petroleum sulfonic acids, alkyl benzene sulfonic acids, oil-soluble fatty acids, alkyl salicylic acids, sulphurised or unsulphurised alkyl phenates, and hydrolysed or unhydrolysed phosphosulphurised polyolefins. Gasoline engine crankcase lubricants typically contain, for example, from 0.5 to 5 weight percent of one or more detergent additives. Diesel engine crankcase oils may contain substantially higher levels of detergent additives. Preferred detergents are the calcium and magnesium normal or overbased phenates, sulphurised phenates or sulfonates.

Pour point depressants which may be present in amounts of from 0.01 to 2 weight percent include wax alkylated aromatic hydrocarbons, olefin polymers and copolymers, and acrylate and methacrylate polymers and copolymers.

Viscosity index improvers, the concentrations of which may vary in the lubricants from 0.2 to 15 weight percent, (preferably from about 0.5 to about 5 weight percent) depending on the viscosity grade required, include hydrocarbon polymers grafted with, for example, nitrogen-containing monomers, olefin polymers such as polybutene, ethylene-propylene copolymers, hydrogenated polymers and copolymers and terpolymers of styrene with isoprene and/or butadiene, polymers of alkyl acrylates or alkyl methacrylates, copolymers of alkyl methacrylates with N-vinyl pyrrolidone or dimethylaminoalkyl methacrylate, post-grafted polymers of ethylene-propylene with an active monomer such as maleic anhydride which may be further reacted with an alcohol or an alkylene polyamine, styrene/maleic anhydride polymers post-treated with alcohols and amines, etc.

Antiwear activity can be provided by about 0.01 to 2 weight percent in the oil of the aforementioned metal dihydrocarbyl dithiophosphates and the corresponding precursor esters, phosphosulphurised pinenes, sulphurised olefins and hydrocarbons, sulphurised fatty esters and alkyl polysulphides. Preferred are the zinc dihydrocarbyl dithiophosphates which are salts of dihydrocarbyl esters of dithiophosphoric acids.

Other additives include effective amounts of friction modifiers or fuel economy additives such as the alkyl phosphonates as disclosed in U.S. Pat. No. 4,356,097, aliphatic hydrocarbyl substituted succinimides as disclosed in EPO 0020037, dimer acid esters, as disclosed in U.S. Pat. No. 4,105,571, oleamide, etc., which are present in the oil in amounts of 0.1 to 5 weight percent. Glycerol oleates are another example of fuel economy additives and these are usually present in very small amounts, such as 0.05 to 0.2 weight percent based on the weight of the formulated oil.

Antioxidants or thermal stabilisers which may be used include hindered phenols, methylene-bridged polyphenols, aromatic amine antioxidants, sulphurised phenols, alkyl phenothiazines, substituted triazines and ureas, and copper compounds such as copper naphthenate and copper oleate, among others.

Detergents and dispersants can also be used in the compositions of this invention, again subject to the proviso that the material used not interfere with the substantial biodegradability of the overall composition. Typical dispersants include the reaction products of hydrocarbyl-substituted acylating agents such as alkenyl- or alkyl-substituted succinic acid or anhydride with amines, phenols, alcohols, aminoalcohols, or basic inorganic materials. Polyiosubtenyl succinimides of alkylene polyamines are preferred dispersants of this type.

Numerous references describe such materials and their use. See for example U.S. Pat. Nos. 3,163,603; 3,184,474; 3,215,707; 3,219,666; 3,271,310; 3,272,746; 3,281,357; 3,306,908; 3,311,558; 3,316,177; 3,340,281; 3,341,542; 3,346,493; 3,351,552; 3,381,022; 3,399,141; 3,415,750; 3,433,744; 3,444,170; 3,448,048; 3,448,049; 3,451,933; 3,454,607; 3,467,668; 3,501,405; 3,522,179; 3,541,012; 3,542,680; 3,543,678; 3,567,637; 3,574,101; 3,576,743; 3,630,904; 3,632,510; 3,632,511; 3,697,428; 3,725,441; 4,234,435; Re 26,433.

Also useful are products formed by reacting aliphatic or alicyclic halides with amines as described, for example, in U.S. Pat. Nos. 3,275,554; 3,438,757; 3,454,555; and 3,565,804.

Mannich reaction products are another type of useful ashless dispersant. Dispersants of this type are described for example, in U.S. Pat. Nos. 2,459,112; 2,962,442; 2,984,550; 3,036,003; 3,166,516; 3,236,770; 3,355,270; 3,368,972; 3,413,347; 3,442,808; 3,448,047; 3,454,497; 3,459,661; 3,461,172; 3,493,520; 3,539,633; 3,558,743; 3,586,629; 3,591,598; 3,600,372; 3,634,515; 3,649,229; 3,697,574; 3,725,277; 3,725,480; 3,726,882; and 3,980,569.

Products formed by post-treating the various types of dispersants referred to above with suitable reactants are also useful. See for example, U.S. Pat. Nos. 3,036,003; 3,087,936; 3,200,107; 3,216,936; 3,254,025; 3,256,185; 3,278,550; 3,280,234; 3,281,428; 3,282,955; 3,312,619; 3,366,569; 3,367,943; 3,373,111; 3,403,102; 3,442,808; 3,455,831; 3,455,832; 3,493,520; 3,502,677; 3,513,093; 3,533,945; 3,539,633; 3,573,010; 3,579,450; 3,591,598; 3,600,372; 3,639,242; 3,649,229; 3,649,659; 3,658,836; 3,697,574; 3,702,757; 3,703,536; 3,704,308; 3,708,422; and 4,857,214.

Polymeric dispersants such as interpolymers of decyl methacrylate, vinyl decyl ether and high molecular weight olefins with monomers containing polar substituents, e.g., aminoalkyl acrylates or acrylamides, and Poly(oxyethylene-)acrylates. Materials of this general type are described, for example in U.S. Pat. Nos. 3,329,658; 3,449,250; 3,519,565; 3,666,730; 3,687,849; and 3,702,300.

Extreme pressure agents which also have corrosion-inhibiting and oxidation-inhibiting properties can also be used. These include chlorinated aliphatic hydrocarbons such as chlorinated wax; organic sulphides and polysulphides such as benzyl disulphide, bis(chlorobenzyl)-disulphide, dibutyl tetrasulphide, sulphurised methyl ester of oleic acid, sulphurised alkylphenol, sulphurised dipentene, and sulphurised terpene; phosphosulphurised hydrocarbons such as the reaction product of a phosphorus sulphide with turpentine or methyl oleate, phosphorus esters including principally dihydrocarbon and trihydrocarbon phosphites such as dibutyl phosphite, dipeptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioates, zinc dioctylphosphorodithioate, barium di(heptylphenyl)phosphorodithioates, cadmium dinonylphosphorodithioates, and the zinc salt of a phosphorodithioc acid produced by the reaction of phosphorus pentasulfide with an equimolar mixture of isopropyl alcohol and n-hexyl alcohol.

Many of the above-mentioned auxiliary extreme pressure agents and corrosion-oxidation inhibitors also serve as antiwear agents. Zinc dialkylphosphorodithioates are a well known example.

Tackiness additives such as HITEC® 151 Additive are also useful.

Other well known components such as rust inhibitors, wax modifiers, foam inhibitors, copper passivators, sulphur scavengers, seal swell agents, color stabilisers, and like materials can be included in the compositions of this invention, provided of course that they are compatible with the base lubricant and the other component or components being employed.

What is claimed is:

1. In an operation wherein lubricating oil or functional fluid is released or likely to be released into the environment, the improvement which comprises providing for use as the lubricating oil or functional fluid a substantially biodegradable lubricating oil or functional fluid at least 10 percent by volume of which is composed of at least one substantially biodegradable liquid hydrocarbon of lubricating viscosity formed by oligomerization of 1-alkene hydrocarbon having 6 to 20 carbon atoms in the molecule and hydrogenation of the resultant oligomer, and wherein said lubricating oil or functional fluid contains a small visually-perceptile chromophoric quantity of at least one oil-soluble chromophoric substance.

2. The improvement of claim 1 wherein the operation comprises the operation of a chain saw, an outboard motor, a hydraulic system, a motor vehicle, or earth-moving equipment.

3. The improvement of claim 2 wherein the substantially biodegradable lubricating oil or functional fluid contains at least 50 percent by volume of the at least one substantially biodegradable liquid hydrocarbon.

4. The improvement of claim 3 wherein the at least one substantially biodegradable liquid hydrocarbon constitutes substantially the entire base oil of the lubricating oil or functional fluid.

5. The improvement of claim 1 wherein the substantially biodegradable lubricating oil or functional fluid contains at least 50 percent by volume of the at least one substantially biodegradable liquid hydrocarbon.

6. The improvement of claim 1 wherein the at least one substantially biodegradable liquid hydrocarbon constitutes substantially the entire base oil of the lubricating oil or functional fluid.

7. The improvement of claim 1 wherein the oligomer is derived from linear 1-alkenes and contains at least 50 percent dimer, trimer, and/or tetramer formed using a water or alcohol promoted Friedel-Crafts catalyst.

8. The improvement of claim 4 wherein the oligomer is derived from linear 1-alkenes and contains at least 50 percent dimer, trimer, and/or tetramet formed using a water or alcohol promoted Friedel-Crafts catalyst.

9. The improvement of claim 1 wherein the oligomer is derived from linear 1-alkenes and contains at least 50 percent dimer, trimer, and or tetramer formed using a water or alcohol promoted Friedel-Crafts catalyst.

10. The improvement of claim 1 wherein the substantially biodegradable lubricating oil or functional fluid contains an oleaginous material which is substantially biodegradable.

11. The improvement of claim 7 wherein the substantially biodegradable lubricating oil or functional fluid contains an oleaginous material which is substantially biodegradable.

12. The improvement of claim 9 wherein the substantially biodegradable lubricating oil or functional fluid contains an oleaginous material which is substantially biodegradable.

13. A substantially biodegradable lubricating oil or functional fluid composition which comprises at least 10% by volume of at least one substantially biodegradable liquid hydrocarbon of lubricating viscosity formed by oligomerization of 1-alkene hydrocarbon having 6 to 20 carbon atoms in the molecule and hydrogenation of the resultant oligomer, and wherein said biodegradable lubricating oil or functional fluid composition contains a small visually-perceptible chromophoric quantity of at least one oil-soluble chromophoric substance.

14. A composition according to claim 13 wherein the substantially biodegradable lubricating oil or functional fluid contains at least 50 percent by volume of the at least one substantially biodegradable liquid hydrocarbon.

15. A method of operating machinery requiring a lubricant or functional fluid under conditions such that said lubricant or functional fluid may escape into the environment wherein said lubricant or functional fluid is a composition as claimed in claim 13.

16. A method of operating machinery requiring a lubricant or functional fluid under conditions such that said lubricant or functional fluid may escape into the environment wherein said lubricant or functional fluid is a composition as claimed in claim 13.

17. A method of operating machinery requiring a lubricant or functional fluid under conditions such that said lubricant or functional fluid may escape into the environment wherein said lubricant or functional fluid is a composition as claimed in claim 14.

18. A method of operating machinery requiring a lubricant or functional fluid wherein said machinery is operated under conditions such that a portion of said lubricant or functional fluid escapes into the environment; wherein said lubricant or functional fluid is a composition as claimed in claim 13; and wherein said lubricant or functional fluid is substantially biodegraded by a microbiological agent in said environment.

19. A method of operating machinery requiring a lubricant or functional fluid wherein said machinery is operated under conditions such that a portion of said lubricant or functional fluid escapes into the environment; wherein said lubricant or functional fluid is a composition as claimed in claim 13; and wherein said lubricant or functional fluid is substantially biodegraded by a microbiological agent in said environment.

20. A method of operating machinery requiring a lubricant or functional fluid wherein said machinery is operated under conditions such that a portion of said lubricant or functional fluid escapes into the environment; wherein said lubricant or functional fluid is a composition as claimed in claim 14 and wherein said lubricant or functional fluid is substantially biodegraded by a microbiological agent in said environment.

21. A method of operating machinery requiring a lubricant or functional fluid wherein said machinery is operated under conditions such that a portion of said lubricant or functional fluid escapes into the environment; wherein said lubricant or functional fluid is a composition as claimed in claim 13; and wherein said lubricant or functional fluid is substantially biodegraded by a microbiological agent in said environment.

22. A method of operating a chain saw requiring a lubricant and under operating conditions such that a portion of said lubricant escapes into the environment, which method comprises utilizing as lubricant for said chain saw a composition as claimed in claim 13 whereby said portion of said lubricant that escapes into the environment is substantially biodegraded by a microbiological agent in said environment.

23. The lubricating oil or functional fluid composition of claim 9 wherein the substantially biodegradable lubricating oil or functional fluid composition contains an oleaginous material which is substantially biodegradable.

24. In an operation wherein lubricating oil or functional fluid is released or likely to be released into the environment, the improvement which comprises providing for use as the lubricating oil or functional fluid a substantially biodegradable lubricating oil or functional fluid which contains a substantially biodegradable liquid hydrocarbon of lubricating viscosity formed by oligomerization of 1-alkene hydrocarbon having 6 to 20 carbon atoms in the molecule and hydrogenation of the resultant oligomer and a visually-perceptible chromophoric quantity of at least one oil soluble chromophoric substance.

25. A substantially biodegradable liquid hydrocarbon of lubricating viscosity formed by oligomerization of 1-alkene hydrocarbon having 6 to 20 carbon atoms in the molecule and hydrogenation of the resultant oligomer, the improvement comprises the addition to said hydrocarbon a small visually-perceptible chromophoric quantity of at least one oil-soluble chromophoric substance.

26. A method of operating machinery requiring a lubricant or functional fluid under conditions such that said lubricant or functional fluid may escape into the environment wherein said lubricant or functional fluid contains at least 10% by volume of a substantially biodegradable liquid hydrocarbon formed by oligomerization of 1-alkene hydrocarbon having 6 to 20 carbon atoms in the molecule and hydrogenation of the resultant oligomer and a small visually-perceptible chromophoric quantity of at least one oil-soluble chromophoric substance.

* * * * *